US007439435B1

(12) United States Patent
Jendrisak

(10) Patent No.: US 7,439,435 B1
(45) Date of Patent: Oct. 21, 2008

(54) CENTER TAPER DRUMSTICK

(76) Inventor: Mark D. Jendrisak, 1754 Limbach Rd., Clinton, OH (US) 44216

( * ) Notice: Subject to any disclaimer, the term of this patent is extended or adjusted under 35 U.S.C. 154(b) by 0 days.

(21) Appl. No.: 11/801,356

(22) Filed: May 10, 2007

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS 3,866,508 A * 2/1975 Huslig ..... 84/422.4
4,095,566 A 6/1978 Hughlett et al.
4,488,470 A 12/1984 Larrain
5,218,152 A 6/1993 Campbell et al.
6,028,260 A 2/2000 LaLonde
6,609,308 B2 8/2003 Raab
2004/0231492 A1 * 11/2004 O'Donnell ..... 84/422.4

OTHER PUBLICATIONS

Rod Cross, Center of percussion of hand-held implements, Am. J. Phys., May 2004, 622-630, 72-(5), University of Sydney, Sydney, NSW 2006, Australia.

* cited by examiner

*Primary Examiner*—Kimberly R Lockett
(74) *Attorney, Agent, or Firm*—John D. Gugliotta, Esq.

(57) ABSTRACT

A solid drumstick tapers towards its balance point to redistribute weight at its shoulder and butt sections. A diameter of the shoulder and the butt portions increases or decreases in a consistent manner so as to not change the drumstick's balance point, but in a manner that still provides a means to move the mass outwards. A flared butt portion is less likely to cause slippage.

10 Claims, 1 Drawing Sheet

CENTER TAPER DRUMSTICK

RELATED APPLICATIONS

There are no previously filed nor current co-pending applications anywhere in the world.

BACKGROUND OF THE INVENTION

1. Field of the Invention

The present invention relates generally to a drumstick and, more specifically, to a drum stick that tapers towards its center point to provide a deeper, louder sound.

2. Description of the Related Art

It is well known that drums are constructed differently to produce and to compliment different types of music. Jazz musicians prefer a crisp, clean sound while rock musicians prefer a loud, deep sound. Typically, the drumhead, the tension of the drumhead, the diameter of the shell and the type of the shell all affect the pitch, the overtones and the sound rings produced by a drum.

It would be more advantageous if a musician can produce a different sound by simply changing the drumstick. This would be especially advantageous for amateur drummers who cannot afford to purchase a variety of drumheads. The present invention is a tapered drumstick that redistributes the weight closer towards the shoulder and the butt portions to produce a deeper and a louder sound. The weight of the stick and the balance point remain the same, thus no additional effort is required by the drummer to alter his or her stroke. There are presently a variety of drumsticks known to alter the sound produced or the grasp's comfort. The following patents are considered related to the present invention.

Most closely related to the present invention is U.S. Pat. No. 4,905,566 to Hughlett et al., wherein the center of gravity is repositioned to 35%-41% along the length of the stick to present a better tonal quality. This is accomplished by enlarging the butt end and constructing a cavity between the balance point and the striking tip.

U.S. Pat. No. 5,218,152 to Campbell et al. teaches a drumstick balanced for juggling, wherein the drumstick exhibits a center of mass in the range of 58% to 62% of the distance along the length. The drumstick was designed to exhibit the "feel" of a juggling club by means of drilling a hole to remove mass from the rear of the stick and inserting brass screw studs at the bead end of the stick. A disadvantage to this invention is the laborious effort required to redistribute the weight.

U.S. Pat. No. 6,069,308 to Raab teaches a rhythm saw that comprises a series of ridges between the handle and the playing tip. The ridges produce a unique sound when they are dragged across an object. U.S. Pat. No. 4,488,470 to Larrain discloses a drumstick that comprises grooves along its intermediate length portion. There are several disadvantages to these inventions. Firstly, most drummers maintain the balance point of a stick slightly beyond their hands, so they have to readjust their hold to an unconventional one that accommodates the ridges. Secondly, the ridges and the grooves obstruct a percussionist's ability to juggle the stick while playing.

U.S. Pat. No. 6,028,260 to LaLonde discloses a drumstick that incorporates an adjustable weight system mounted within its hollow interior. The drumstick is symmetrical about its longitudinal axis. A disadvantage to this invention is that it must be disassembled for access to its hollow interior to add or to subtract weights.

Finally, U.S. Pat. No. 3,866,508 to Huslig discloses a drumstick that comprises two generally flat surfaces that oppose one another along at least a portion of the length. While this design provides the benefits of a more comfortable grip, a beginner percussionist will ultimately graduate to a more conventional stick that does not comprise a means to obstruct the juggling.

The present invention is an improved drumstick that tapers towards its balance point. The present invention resembles a conventional wooden drumstick and it handles in a similar manner; however, the tapered section offers the drummer a better and a more comfortable grip while also affording the drummer a better design for juggling.

SUMMARY OF THE INVENTION

It is an object of the present invention to provide an improved wooden drumstick. It is an object of the present invention to provide an improved construction that can be utilized for conventional, wooden drumsticks as well as with ones manufactured from other common materials. It is an object of the present invention to provide a drumstick that handles in a manner similar to conventional drumsticks and does not require any additional effort to strike like conventional drumsticks.

The foregoing objects are accomplished by means of a drumstick that tapers towards its balance point, thus it redistributes the weight towards the shoulder and the butt sections. It is an object of the present invention to teach a drumstick that weighs the same as a conventional drumstick and one that comprises the same balance point.

An advantage to the improved drumstick is a deeper and a louder sound produced by the drumstick. Another advantage to the drumstick is that the percussionist may produce this sound without the expense or the effort required to change drumheads. It is a further advantage of the drumstick to provide a means to change the sounds desired for a type of music simply by changing the stick.

It is envisioned that the foregoing advantage is accomplished by means of a redistribution of the mass of the present drumstick, which changes the resonate frequency of the drumstick. The location of the vibration nodes are shifted to cause a lower sound. The redistribution of mass also causes an increased contact time with a drumhead to provide the same impact. Velocity similarly adds to a deeper sound.

In addition to the changes in resonate frequency, the redistribution of mass also changes the center of rotation and moves it closer to the butt or the end opposite the one used to strike a drum head. Similarly, the change in the center of rotation provides less vibration through the drumstick because the center is moved more in line to where a drumstick is generally held. Essentially, the center of rotation is moved to a point where the vibrations felt from the striking of the tip are equal and opposite, thus they cancel each other out.

Another advantage to the present mass redistribution is that it provides a more comfortable and an easier means to juggle, to twirl and to perform tricks with the drumstick. It is more common for marching percussionists to add to their performance for entertainment or competitive purposes. The present design enables these percussionists to add to the variety and the difficulty of the tricks they perform.

This is accomplished by means of the drumstick being heavier at its shoulder and its butt portion. Conventional drumsticks vary in weight from approximately 1.5 to 2.5 oz. per drumstick. The diameter of the shoulder and the butt portions of the present center-tapered drumstick is increased or decreased in a consistent manner so as to not change the balance point of the drumstick, but in a manner that still provides a means to move the mass outwards. Similar to a twirling baton, the weighted portions are positioned towards the terminal ends of the length to provide greater ease and stability. It is a further advantage that the present drumstick provides its drummer a more comfortable grip. The flared butt portion of the present stick is less likely to slip form the hand of a person utilizing it.

It is one final object of the present invention to provide a design that requires no cavity, no hollow interior nor any portion of the interior be removed or accessed. It is an advantage to this object that the cost of manufacture is reduced significantly and therefore approximates the cost of manufacture for a traditional drumstick.

Other objects of the invention will become better apparent from the drawing and the more detailed description of the illustrative embodiments.

BRIEF DESCRIPTION OF THE DRAWINGS

The advantages and the features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

Figure 1:
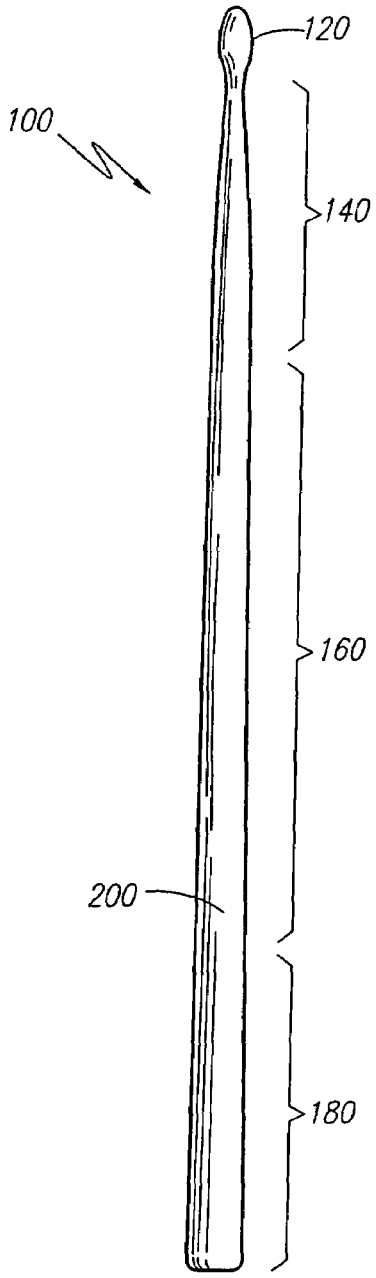
FIG. 1 is a perspective view of the PRIOR ART, wherein a conventional drumstick is shown; and, FIG. 2 is a perspective view of the center tapered drumstick according to the present invention.

In order to describe the complete relationship of the improved invention to the prior art, it is essential that some description be given to the manner and to the practice of the functional utility of a conventional drum stick. A conventional drumstick 100 is shown in FIG. 1. Conventional drumsticks 100 comprise a tip 120, a shoulder 140, a shaft 160 and a butt 180. The tip 120 can be acorn shaped, barrel shaped, oval shaped or rounded. The tip 120 typically strikes the drumhead to produce a sound. The shoulder 140 is the portion of the length that tapers from the shaft 160 to the tip 120. The length of the shoulder 140 approximates one quarter (¼) the length of the drumstick 100. The shaft 160 is the cylindrical portion that travels across the greater part of the center length where the percussionist grips the drumstick 100. The shaft 160 approximates one half the length of the drumstick 100. The shaft 160 is straight and it maintains the same circumference throughout its length. The butt 180 is opposite the tip 120 and is rounded at its end. The butt 180 approximates about one quarter (¼) the length of the drumstick 100. Percussionists keep the balance point 200 of the stick slightly beyond their hands.

1. DETAILED DESCRIPTION OF THE FIGURES

Figure 2:
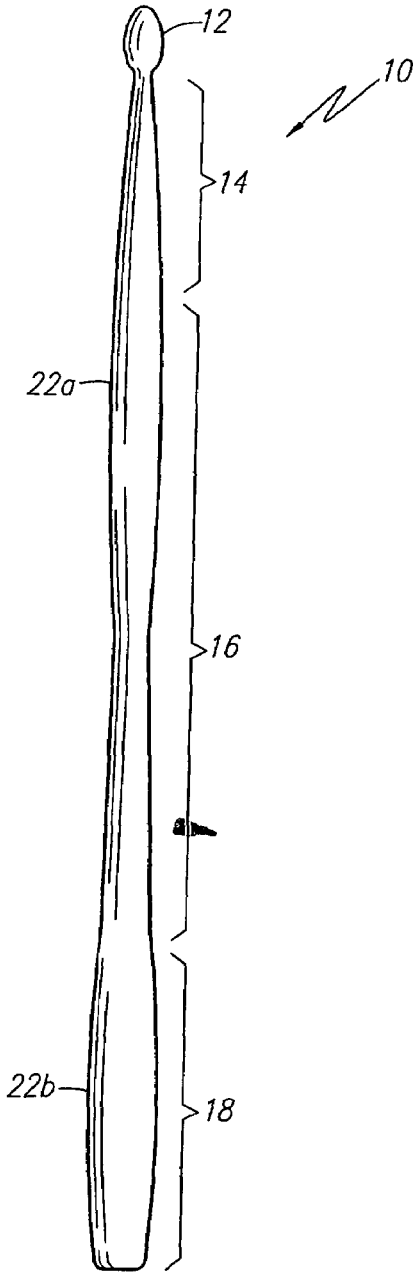

The preferred embodiment of the center tapered drumstick 10 according to the present invention is shown in FIG. 2. The center tapered drumstick 10 similarly comprises a tip 12, a shoulder 14, a shaft 16 and a butt 18 so that it resembles for the most part the drumstick 100 shown in FIG. 1. The center tapered drumstick 10, however, varies in the construction of the shaft 16 portion. Although the shaft 16 remains cylindrical along the length, it begins to taper at the portion where the flared butt 18 and the shaft 16 approximately meet. At the approximate center of the entire length of the center tapered drumstick 10, the shaft 12 begins to broaden towards the shoulder 12 so that the circumference where the shaft 14 and the shoulder 12 meet approximates the circumference comprised in the flared butt 18 portion. The weight of the drumstick 10 is distributed towards the two portions 22*a*, 22*b* along the length that comprise the largest circumference. To maintain the same weight as a conventional drumstick 100, the drumstick 10 may either comprise a slightly longer length or the circumference of the flared butt 18 portion and the widest part of the shaft 16 portion may be slightly greater to accommodate the weight lost by the slightly narrower shaft 16 portions. Alternatively, the shoulder 14 portion may begin to taper for a shorter distance. For any of the foregoing constructions, the balance point remains the same so that a drummer will grip the drumstick 10 in a manner similar to that known for conventional drumsticks 100.

It is envisioned that the most narrow portion of the tapered center comprises a diameter that approximates ⅔ the diameter of the flared butt 18 portion; however, the approximations are not limited to the ones disclosed for the purposes of enablement. For example, the diameter may vary from ½ inch at the center portion to approximately ¾ inch at the butt 18 and the shoulder 14 portions.

The present invention can be accomplished using drumsticks manufactured from a variety of woods, including Ash, Maple, Oak American Hickory, etc. Similarly, the design may be utilized for drumsticks manufactured from aluminum, plastics and other nonconventional materials. The design of the shoulder 14 and the tip 12 is not limited to the ones shown in FIGS. 1 and 2, but rather, the present design may additionally be utilized with drumsticks that comprise shoulders and tips that vary in shape and structure.

It is further envisioned that the present design may be utilized in combination with the ridges, the grooves, the grips and the other additions to conventional drumsticks taught in the prior art.

2. OPERATION OF THE PREFERRED EMBODIMENT

To utilize the present invention, a drummer may grip the drumstick just beyond the balance point. A drummer may employ a matched grip or a traditional grip when utilizing the present invention. The drummer would twirls or mock twirls the present invention at the tapered center portion. The drummer similarly tosses and catches the drumstick at the tapered center portion. The drummer strikes the drum utilizing the tip or the butt portions of the present drumstick in the same manner utilized for conventional drumsticks. The present drumstick may be used solely to produce a louder and a deeper sound, it may be utilized with different shaped tips to produce a desired sound, or it may be switched and used in combination with conventional sticks to produce a combination of softer and louder sounds.

The foregoing descriptions of specific embodiments of the present invention have been presented for the purposes of illustration and description. They are not intended to be exhaustive nor to limit the invention to the precise forms disclosed and, obviously, many modifications and variations are possible in light of the above teaching. The embodiments were chosen and described in order to best explain the principles of the invention and its practical application, to thereby enable others skilled in the art to best utilize the invention and the various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A center tapered drumstick, said drumstick comprises:

a tip;

a cylindrical shoulder portion that tapers towards said tip;

a cylindrical shaft portion; and, a cylindrical flared butt portion that terminates at a rounded butt;

wherein, said shaft portion tapers from an approximate point where said butt portion and said shaft portion meet to an approximate midpoint along a length of said drumstick; and, wherein said shaft portion begins to broaden at said midpoint and along said length so that a circumference of a point where said shaft portion meets said shoulder portion approximates a circumference comprised in said butt portion.

2. The drumstick of claim 1, wherein said butt portion approximates one quarter said length of said drumstick and said shaft portion approximates one half said length of said drumstick.

3. The drumstick of claim 1, wherein the most narrow portion of said tapered shaft comprises a diameter that approximates ⅔ that of said flared butt portion.

4. The drumstick of claim 1, wherein a diameter varies from ½ inch at a most narrow portion of said tapered shaft to approximately ¾ inch at said butt and said shoulder portions.

5. The drumstick of claim 3, wherein a smallest circumference that corresponds to said most narrow portion is at said approximate midpoint along said length of said drumstick.

6. The drumstick of claim 5, wherein a greater part of a weight of said drumstick is distributed between said butt and said shaft portions that comprise a largest circumference.

7. The drumstick of claim 6, wherein said circumference of said butt portion is slightly greater than a circumference of a widest portion of said shaft portion to accommodate the said weight lost by a slightly narrower section of said shaft portion.

8. The drumstick of claim 6, wherein said length of said drumstick is greater than that of a conventional drumstick.

9. The drumstick of claim 6, wherein said shoulder portion comprises a length less than that of a shoulder portion comprised on a conventional drumstick and a shaft portion that comprises a length slightly greater than that of a shaft portion of a conventional drumstick.

10. The drumstick of claim 1 further a means to prevent slippage of said drumstick, said means is selected from a group comprising:

ridges;

grooves; and, grips.

* * * * *